US005356480A

United States Patent [19]

Melgeorge

[11] Patent Number: 5,356,480

[45] Date of Patent: Oct. 18, 1994

[54] METHOD OF WASHING HOSE

[76] Inventor: Edward L. Melgeorge, R.R. 1, Box 2222H, Nashwauk, Minn. 55769

[21] Appl. No.: 144,899

[22] Filed: Oct. 29, 1993

Related U.S. Application Data

[63] Continuation of Ser. No. 840,753, Feb. 24, 1992, abandoned, which is a continuation-in-part of Ser. No. 581,741, Sep. 13, 1990, Pat. No. 5,113,884.

[51] Int. Cl.[5] ..... B08B 3/02

[52] U.S. Cl. ..... 134/15; 134/64 R; 134/64 P; 134/122 R; 134/122 P; 134/166 C; 134/199

[58] Field of Search ..... 134/15, 64 R, 64 P, 134/122 R, 122 P, 166 C, 199; 100/100, 171, 176

[56] References Cited

U.S. PATENT DOCUMENTS

| | | | |
|---|---|---|---|
| 415,935 | 11/1889 | Boynton et al. | 134/64 R |
| 425,642 | 4/1890 | Villeneuve | 134/122 |
| 2,651,312 | 6/1951 | McBeth | 134/122 R |
| 3,966,544 | 6/1976 | Johnson | 162/275 |
| 4,348,781 | 9/1982 | Wahlström et al. | 134/64 R |
| 4,502,175 | 3/1985 | Hillis | 15/104.92 |

*Primary Examiner*—Richard O. Dean
*Assistant Examiner*—Zeinab El-Arini
*Attorney, Agent, or Firm*—Merchant, Gould, Smith, Edell, Welter & Schmidt

[57] ABSTRACT

A method of washing hose using high water pressure, fire hose washing apparatus generally having a back plate, cleaning heads with spray nozzles mounted to the back plate, and optionally, guide rollers rotatably mounted to the back plate. Optionally, the apparatus may have rollers oriented to direct hose in a generally serpentine pattern. The washing apparatus may also comprise means for taking up washed hose, means for shutting off the hose washer including, for example, a hood switch or an electromechanical plate for sensing the hose coupling, means for washing the edge of the treated hose and means for loading hose into the hose washing apparatus. Also disclosed is a method of using the high water pressure hose washing apparatus and a high water pressure cleaning system.

22 Claims, 4 Drawing Sheets

METHOD OF WASHING HOSE

This is a continuation, of application Ser. No. 07/840,753, filed Feb. 24, 1992, now abandoned, which is a continuation-in-part to U.S. patent application Ser. No. 07/581,741 filed Sep. 13, 1990, and now U.S. Pat. No. 5,113,884.

FIELD OF THE INVENTION

The present invention relates generally to automatic hose washers. More specifically, the present invention relates to means for washing large volume hoses such as fire hose and the like at a high rate through the application of high pressure water.

BACKGROUND OF THE INVENTION

High volume hose has always presented maintenance and care concerns regardless of the application in which it is used. Unlike hose used by the residential homeowner, high volume hose such as that used by fire departments, mining companies, air carriers, and in farming irrigation operations tends to comprise a heavy work piece of considerable dimension. The length and weight of the hose necessitate extended effort in laying and charging the hose as well as in recovery and care of the hose after use.

Additionally, the applications in which this type of hose is used often result in extended exposure to dirt, soot, cinders, ash, degrading solvents and the like. The environmental conditions in which a hose is used may also result in exposure to flame and high temperature, truck traffic over the hoses, and other pressures and stresses not encountered by conventional garden hose. As a result, hose cleaning must be undertaken to both maintain the structural integrity of the hose and to ensure that a prior application has not compromised the hose. Operator safety is often dependent on careful inspection and recognition of structural inadequacies in hose.

In the case of fire hose, each length comprises a substantial capital investment by a fire department. Moreover, substantial energy is invested, usually through the manual labor of fire department personnel, in washing, rinsing, and drying hose. Generally, fire hose is washed by laying the hose flat on the floor of the department garage. Water is then applied and the hose is then manually scrubbed with a brush and soap. As each fire truck may carry thousands of feet of hose, manual washing can take hours. Moreover, once the hose has been washed it is generally hung in a drying tower or the like prior to repacking on the fire truck.

To save the investment of time and energy in the care and maintenance of hose a number of devices have been developed. For example, U.S. Pat. No. 3,531,059 to T. J. Walker discloses a fire hose loader, cleaner and drier contained within a mobile apparatus such as a panel truck. U.S. Pat. No. 4,502,175 to Hillis discloses a portable fire hose cleaning apparatus adapted to be connected to a conventional fire hydrant. In operation, the hose is manually manipulated between the brushes and the members in order to adequately wet and clean its outer surface.

U.S. Pat. No. 4,438,781 to Wahlstrom et al discloses a hose cleaning plant which comprises a hose magazine, washing equipment, and a hose transport device which in operation pulls the hose through washing equipment over the extended length of the hose cleaning plant.

U.S. Pat. No. 4,280,672 to Santos et al discloses a compact fire hose washer generally comprising means for wetting the hose, introducing soap onto the surface of the hose, scrubbing the hose, and rinsing the hose.

U.S. Pat. No. 3,827,097 to Hamann discloses a hose washer which may be used for large volume hose such as fire hose or agricultural irrigation hose comprising a washer inside a guide chamber which passes the washed hose onto a spindle. In operation, hose passes through the guide chamber comprising an outer housing and inner perforate shell. Once in the guide chamber, the hose is contacted with a water flow injected into the outer housing of the guide chamber and directed onto the hose by the inner perforated shell.

Essentials of Firefighting, Copyright June, 1983, International Fire Service Training Association (IFSTA) disclose methods and devices for washing and drying fire hose. Specifically, in FIGS. 10.3 and 10.4 shown on page 220, there are two fire hose washing apparatuses shown. The first fire hose washer, FIG. 10.3, uses the flow of water into a cylindrical pipe to wash fire hose up to 3 inches in diameter. Optionally, the water pressure in the device can be used to facilitate the movement of hose through the pipe. Another type of hose washing apparatus is shown in FIG. 10.4 using a series of brushes and rollers to effectively wet, scrub, and drain fire hose.

However, a large problem with industrial hose is that the hose is exposed to elements which do not lend themselves to cleaning with the manual application of soap, water, and brush. For example, hose which generally has a cloth outer wrap, is often exposed to dirt and other contaminants which cannot be removed by the previously mentioned practices and devices. Additionally, hose washing machines previously available do not readily accommodate the high volume of hose soiled, or the severe level of sediment and residue, often resulting from various applications, such as fire scenes, without extended physical labor. Accordingly, a need exists for an industrial hose washing apparatus capable of cleaning hose which has been exposed to severe environmental conditions and soiled as a result of that exposure.

SUMMARY OF THE INVENTION

Before the present invention, high pressure water has not been used or applied to the cleaning of hose. The present invention provides a hose cleaning apparatus using high pressure water and an automatic drive mechanism to pull hose through the apparatus with minimal manual labor. The apparatus of the present invention applies high pressure water to hose. The present invention is especially suited to remove ground-in residue from the cloth outer wrapping of fire hose. The apparatus of the present invention is capable of cleaning any hose in an efficient and thorough manner including hose which has a flat profile when uncharged.

In accordance with the present invention there is provided a high water pressure, hose washing apparatus which generally includes a back plate and cleaning heads mounted to the back plate. The present invention may also comprises one or more guide rollers rotatably attached to the back plate. Each guide roller may generally be positioned adjacent the water cleaning head.

The present invention may also generally comprises a drive roller attached to the back plate. The drive roller is rotatable at various speeds by connection of the drive roller to an external power source. The present invention's drive system also comprises a pressure roller positioned in tension contact with the drive roller and attached to the back plate by a spring. Optionally, the apparatus of the present invention may also include a reel for loading hose into the hose washing apparatus.

The present invention also provides a method of using a high water pressure hose washing apparatus and a high pressure cleaning system using the hose washer of the present invention.

DETAILED DESCRIPTION OF THE PREFERRED EMBODIMENTS

The present invention comprises a high water pressure hose cleaner, a method of using a high water pressure hose cleaner, and a high pressure cleaning system which has a high pressure hose cleaner as an accessory to the system.

High Pressure Hose Cleaner

Figure 1:
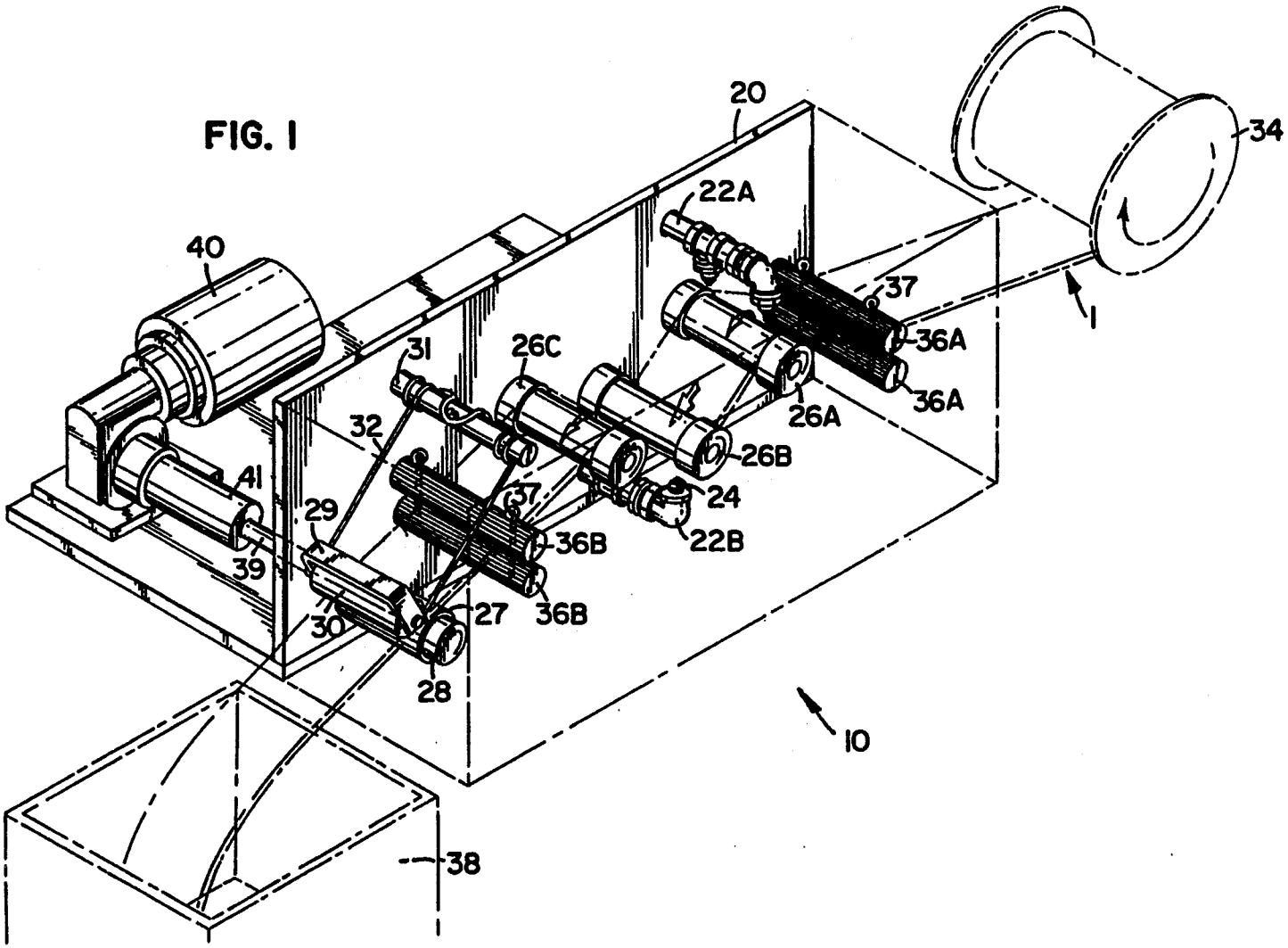
FIG. 1 is a perspective view of a high pressure hose washing apparatus in accordance with a preferred embodiment of the present invention.

Referring to the Figures wherein like parts are designated similarly through several views, a high pressure hose cleaner 10 is shown in FIG. 1. The high water pressure, hose washing apparatus 10 generally includes a back plate 20 of a given thickness, length, and width sufficient to support the apparatus. Mounted on the back plate 20 are cleaning heads 22A and 22B. The cleaning heads 22A and 22B are attached to the back plate 20 and pass through and extend outwardly beyond and perpendicular to the back plate 20. The cleaning heads generally have nozzles 24 positioned across their length. The spray nozzles 24 are positioned to direct the water generally parallel to the back plate 20. In the most preferred embodiment, the nozzles of cleaning head 22A are directed downwardly towards guide roller 26A and the nozzles 24 of cleaning head 22B are directed upwardly towards guide roller 26B.

Figure 2:
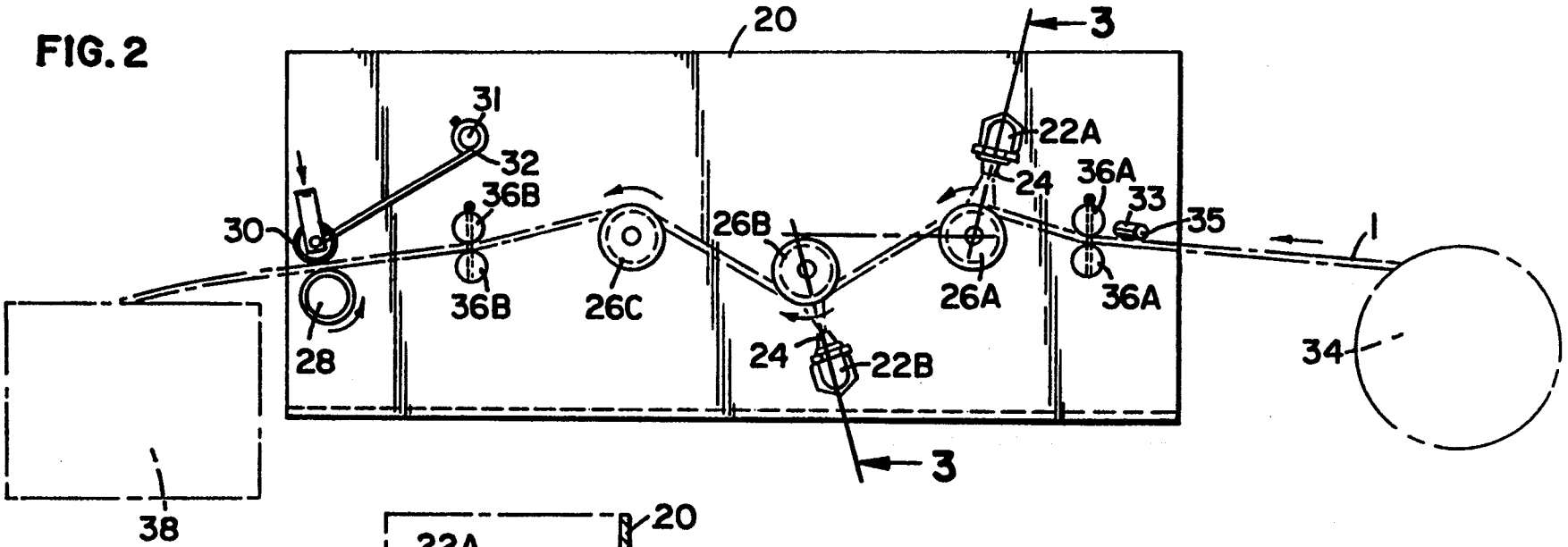
FIG. 2 is a side elevational view of a high pressure hose washing apparatus shown in FIG. 1 in accordance with a preferred embodiment of the present invention.

The present invention may have three guide rollers 26A, 26B, 26C each extending outwardly from, and rotatably attached to, the back plate 20, FIG. 2. Alternatively, guide roller 26C may be replaced by drive roller 28 if a more compact arrangement of the apparatus is preferred, see FIG. 4. Preferably, the guide rollers are oriented to direct hose 1 in a generally serpentine pattern through the apparatus, FIG. 2. The first guide roller 26A may be attached to the back plate adjacent the first cleaning head 22A. Another guide roller 26B may be positioned adjacent the second cleaning head 22B in the path of the spray nozzles 24. A third guide roller 26C may generally be positioned upward from the second guide roller towards the top and second side edge on the back plate 20 to assist in guiding the hose through the drive system.

The present invention may also comprise a drive system including a drive roller 28 rotatably attached to the back plate 20. The drive roller 28 extends outward from the back plate. The drive roller 28 may be rotated at various speeds by connection to an external power source 40, FIGS. 1 and 3. Meeting the drive roller 28 is a pressure roller 30 positioned in tension contact with the drive roller 28. The pressure roller 30 is affixed to the back plate 20 by a spring 32 anchored by stationary pin 31.

Turning to the specific features of the present invention, a back plate 20 provides structural support, weight and portability to the apparatus of the present invention, FIGS. 1 and 2. Generally, the back plate 20 may take on any configuration which provides a structure of adequate strength, weight and size to support various elements of the hose washing apparatus.

Materials generally useful for forming a back plate of adequate strength include metal alloys such as steel, iron, alloyed aluminum and the like. Also useful are modern high strength polymers such as para-aramides which combine strength with optimal weight characteristics. Due to the high exposure to water, the back plate is preferably made from or coated with rust resistant materials. One type of coating especially preferred is epoxy paints due to their wearability and hardness.

Figure 3:
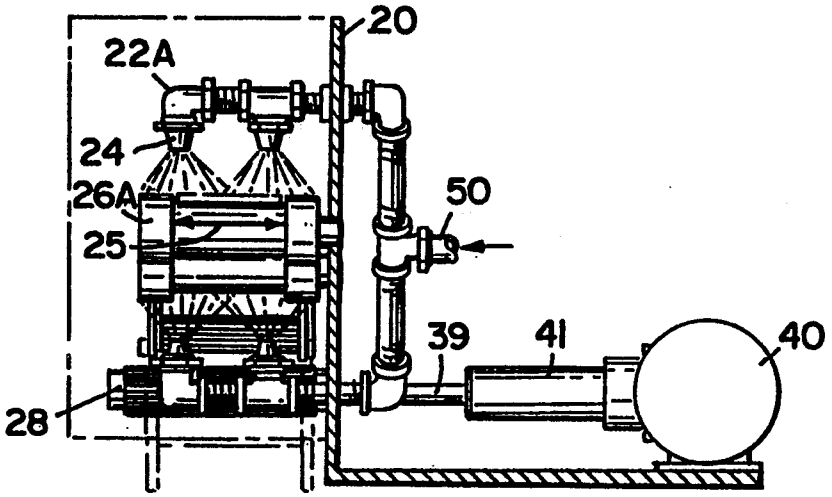
FIG. 3 is a cross-sectional view taken along line 3—3 showing a preferred embodiment of the present invention as depicted in FIG. 2 and further showing cleaning heads and water nozzles as well as guide rollers used in the present invention.

Preferably, as can be seen in FIGS. 1–3, the back plate 20 is generally square having a top edge, a bottom edge, and two side edges. Generally the most preferable material for use as a back plate is stainless steel or alloyed aluminum having a thickness varying from about $\frac{1}{8}$ inch to about $\frac{1}{4}$ inch. These metal alloys are most desirable for the ready attachment of various elements of the apparatus through soldering, spot welding, or preferably by threading and bolting. In practice, bolting the various elements to the back plate 20 has been found to be the most effective means of attaching elements to the back plate. Bolting elements to the back plate 20 allows for easy replacement or maintenance of parts or interchanging of elements having a different size to accommodate the cleaning of hose of various size.

Although the size of the back plate can vary considerably in dimension, the height of the back plate generally varies from about 9 inches to about 16 inches and the length of the back plate generally varies from about 24 inches to about 48 inches. This range in size allows for the adequate spacing and positioning of the elements of the hose washing apparatus including guide rollers, washing means, and guide pins.

Although the Figures in the present application depict the present invention as exposed, any variety of covers may also be used to enclose the motor 40 or apparatus 10. Generally, these housings function to contain water spray during operation, protect the apparatus operator, and protect the motor from damage. The apparatus may be covered by a metal alloy or polymeric hood hinged at the top edge of the back plate 20. Similarly, the engine may be covered with a metal alloy hood. This allows the hood to be flipped up prior to or after operation. Preferably, the hood is made of a clear material such as plexiglass, allowing visible operation of the apparatus with the hood in place.

The present invention also comprises means for applying a high pressure spray of water to the hose. Generally, the hose washing means functions to direct water towards a specific area through which the hose will pass applying a pressurized water flow over the surface of the hose. This pressurized water flow is intended to dissolve and dislodge particulate residue and sediment stuck on the surface of the hose.

Generally, the hose washing means may take on any number of configurations, which for example, may be as simple as the use of a single cleaning head having two nozzles for the application of pressurized water flow to the hose. In this instance, hose may be run through the apparatus twice in order to clean both sides adequately.

Preferably, as can be seen in FIGS. 1–3, the hose washing means of the present invention comprises a pair of cleaning heads 22A, 22B which extend outwardly from the back plate over the guide rollers 26A and 26B. The cleaning heads 22A, 22B have any number of nozzles 24 across the length of the head. While the cleaning heads 22A, 22B may be positioned in any variety of configurations, as can be seen in FIG. 2, cleaning heads 22A and 22B are preferably configured in a diagonal orientation in relationship to each other.

Further, cleaning heads 22A and 22B may be generally cocked back at an angle in relationship to guide rollers 26A and 26B, FIG. 2. The angle of the cleaning heads in conjunction with the serpentine pattern of the hose as it is pulled over the guide rollers 26A and 26B facilitates the further penetration of the cloth outer wrap or an otherwise irregular outer casing where residue and particulate may become lodged or embedded. Moreover, the use of two cleaning heads positioned on either side of the hose provides for the efficient cleaning of the hose with one pass through the machine.

Cleaning action by the apparatus of the present invention is dependent upon water flow and water pressure. The value of these two parameters depends upon the residue to be removed from the hose. Generally, the cleaning heads may have any inner diameter necessary to provide the necessary water flow and pressure thus providing the necessary force and irrigation to remove residue. Preferably, the inner diameter of the cleaning head ranges from about 0.25 inch to 0.4 inch. The cleaning heads may be attached to the back plate 20 through keyed, quick disconnects. For example, in use, attachment through quick disconnects allows easy replacement of a cleaning head generally having two nozzles, for a 1.5 inch diameter hose, with a cleaning head generally having four nozzles, for a 5 inch diameter hose.

Keying the quick disconnects assures that the nozzles always retain the same angle in relationship to their respective guide roller.

Figure 4:
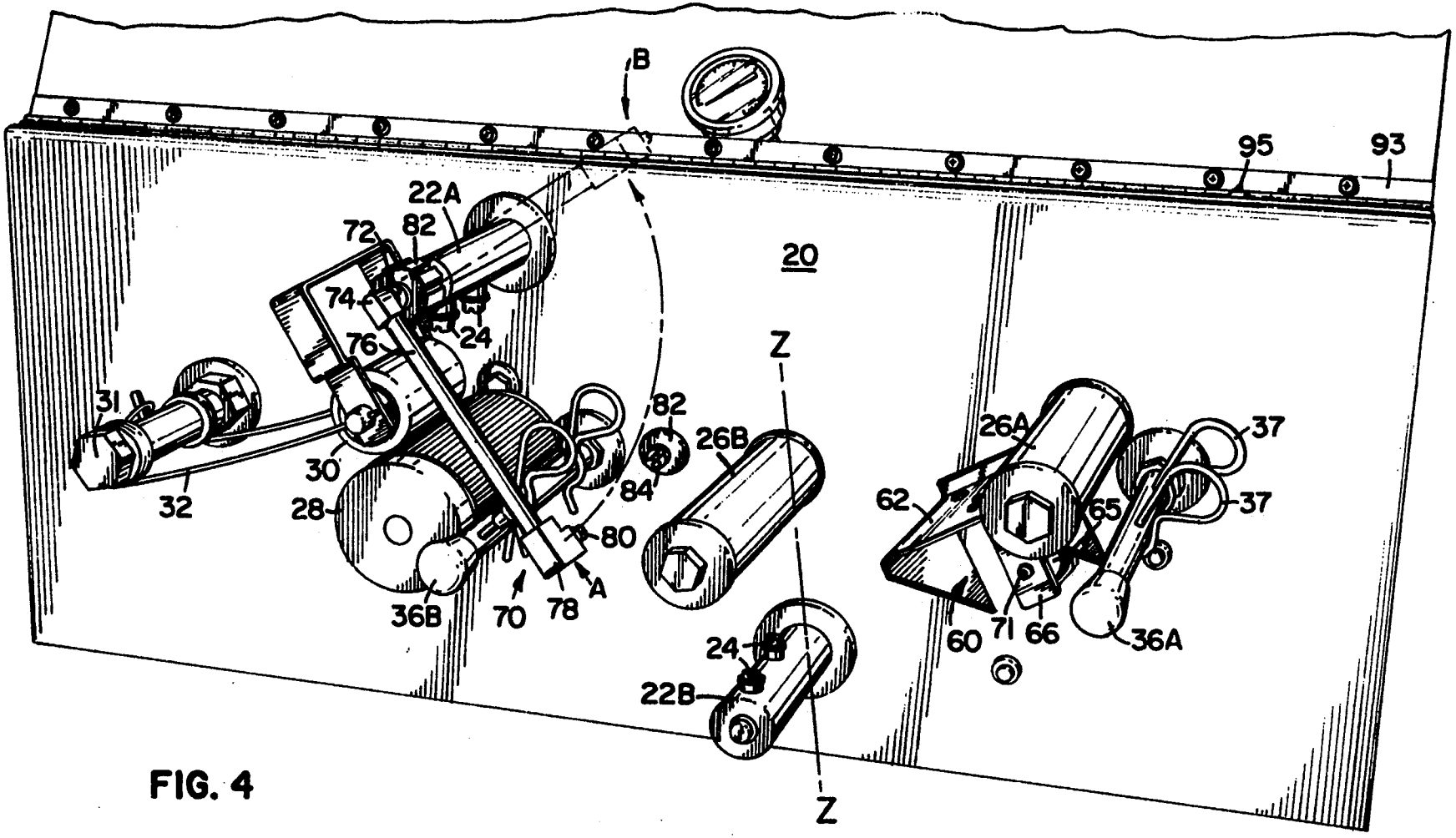
FIG. 4 is a perspective view of a high pressure hose washing apparatus in accordance with an alternative preferred embodiment of the invention.

While the cleaning heads may be oriented at an angle to the rollers, the cleaning heads are preferably substantially 90 degrees in relation to the substrate, such as for example hose being washed. As can be seen in FIG. 4, cleaning head 22B and guide roller 26B are preferably oriented substantially perpendicular to each other on axis Z—Z'. This provides a more preferred cleaning action to hose.

The spray heads may be positioned within a broad range of distances from the hose rollers. For example, the distance between spray head 22B and roller 26B may vary considerably depending upon the angle of spray pattern and hose width, the potential water pressure from the hose, as well as the rate at which hose is propelled through the apparatus. Increasing the spray angle may allow for cleaning broader hose with fewer nozzles from a greater distance. However, an increase in distance from the spray head 22B and nozzles 24 to the roller 26B on axis Z—Z (FIG.4) may decrease the water pressure incident on any hose being washed. Generally, the distance may vary from about less than 1 inch to 8 inches, preferably from about 1 inch to 4 inches, and most preferably from about 2 to 3 inches. With a 40-04 nozzle, a distance of about 2.5 inches has been found most preferable.

Turning to the nozzles 24, any variety of nozzle sizes, angles and material may be used in accordance with the present invention. Generally, the number of nozzles used may vary depending upon available water flow and pressure, and the size and condition of hose to be washed. Preferred systems generally comprise cleaning heads having two to four nozzles mounted thereon.

Generally, nozzles are rated on the basis of the angle of water projected from the nozzle head during use and the water flow useful for any specific nozzle. Preferred nozzles have a narrow or more direct spray pattern such as, for example, a 15 - 02 nozzle as nozzle size is accepted and defined by those of skill in this art. This is a nozzle having a 15° spray pattern angle rated at 02 for water flow volume. However, it is also preferable to have a nozzle which provides adequate coverage over the hose surface to provide efficient cleaning.

Adequate coverage may be obtained by using more nozzles or nozzles providing a larger angle of water spray. The nozzle size may be varied depending on the size of the hose and the available water pressure. Most preferably, the cleaning head used in accordance with the present invention comprise four nozzles of size 40 - 04. This nozzle size combines the optimum coverage of hose surface with a substantially narrow spray pattern. Materials useful in forming the nozzles of the present invention include ceramics, metal alloys and the like. These materials are also useful in forming the cleaning heads of the present invention.

The apparatus may also comprise means for extending the high pressure water to clean either edge of a hose as can be seen at 70 and 82 in FIG. 4. The edge cleaning means functions to clean the outside edge of the hose so as not to require any additional labor during the hose washing process. Accordingly, any design consistent with this function may be used in accordance with the invention. Generally, any variety of configurations may be used to clean the hose edge including nozzles inserted through the back plate or nozzles extended from the cleaning head. One edge cleaning apparatus may comprise an arm 76 attached to the cleaning head 22A which is rotatable in a plane substantially parallel to the back plate 20.

Specifically, cleaning head 22A may be fitted with an outer screw cap 82 which has a rotatable arm 70 attached thereto. The arm rotates through the action of a rotatable attachment 72 to the screw cap. The arm generally may comprise any number of elements. One preferred embodiment has been found to comprise an elbow joint or turn 74, a longer pipe length 76, and second elbow joint 78 to which is attached a nozzle 80. Pipe length 76 is generally configured to allow the arm to be directed at the hose as it is passed through the hose washing machine. Movable attachment means 72 is configured so as to allow the arm to be swung into position for washing hose (position A) or moved to position B, FIG. 4 so as to allow loading and unloading of the hose. The use of screw on cap 82 allows for the addition or removal of the spray arm in environments where the arm may or may not be appropriate.

Mounted on the back plate 20, a nozzle 84 may also be positioned to direct water at the other edge of any hose washed in the apparatus. As can be seen, nozzle 84 may be provided as an extension of other plumbing in the apparatus such as spray head 22B. Nozzle 84 may be held in place by means such as bolts, washers and the like and sealed from moisture through means such as a rubber grommet 82, FIG. 4. Unlike the spray head nozzles 24, nozzles 80 and 84 may provide a smaller pattern of spray. One pattern found preferable in the range of nozzles otherwise desirable is 25°- 02.

Generally, the hose washing apparatus of the present invention may be used as an accessory of a high pressure water system or as a free standing hose washing apparatus having its own source of high pressure water. Any supply of water which may adequately be attached to the system 50 at the back plate and supply the appropriate pressure and volume of water may be used, FIG. 3. Preferred pressure for use in the present invention generally ranges from about 200 psi to 1000 psi, more preferably about 500 psi to 900 psi, and most preferably from about 650 psi to 750 psi. The water flow generally ranges from about 2 gpm to 10 gpm, and most preferably from about 5 gpm to 7 gpm. These ranges are merely guidelines. However, these ranges provide the most efficient cleaning of hose having all types and varieties of residue and contaminants contained therein.

In order to facilitate the transport of hose through the hose washing apparatus of the present invention, there may also be provided guide rollers. Generally, any number of guide rollers may be used in the present invention. These guide rollers may be positioned adjacent to the cleaning heads 22A and 22B in order to facilitate transport of the hose 1 through the apparatus 10, FIG. 2.

In accordance with the present invention it is generally desirable to have a guide roller positioned within exposed to high pressure water flow immediately in the path of water flowing from nozzles 24 and adjacent to the back plate 20. The guide rollers also function in the most preferred embodiment of the present invention to bend the hose in a serpentine pattern, FIG. 2, further exposing the nap of the hose cloth outer lining to the area underneath the spray nozzles 24.

The rollers generally comprise a sleeve rotatably attached through the application of a pin or bolt to the back plate 20. The sleeve may be any number of compositions including metal alloys, or high strength synthetic polymer compositions such as polyurethanes which may have a variable hardness depending upon the application.

Washers may be used at the interface between the bolt end and the sleeve, and the sleeve and the back plate to ensure free rotation of guide rollers. If guide rollers are attached to the back plate 20 by bolting, generally two nuts are used on either side of back plate 20 to ensure free rotation of the cylinder as well as adequate structural support. As the guide rollers may be constructed without bearings, the sleeve materials found most preferable are those having a high material hardness. Optimally, materials having a hardness of 90 durometers or greater have been found preferable. Materials which are self-lubricating or water lubricated may also be used in the present invention. One material believed preferable for use as a guide roller sleeve includes varying grades of nylon.

Figure 5:
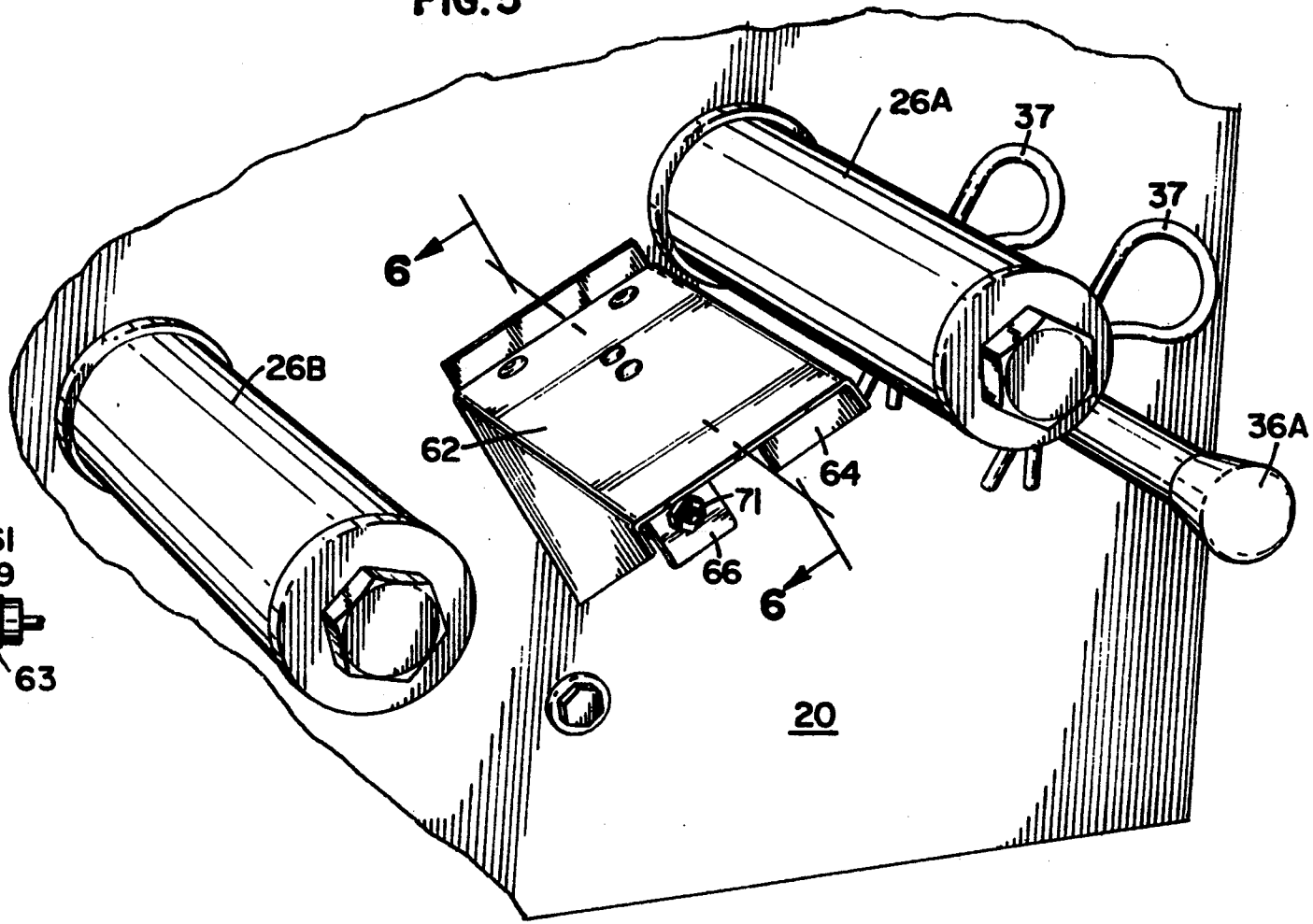
FIG. 5 is an enlarged perspective view of the shut off means shown in FIG. 4 in accordance with an alternative preferred embodiment of the invention.

Optionally, the roller 26A may also be slotted with groove 25, FIG. 3 to adequately carry hose of any given number of widths through the hose washing apparatus. Alternatively, guide pins 37, FIGS. 4 and 5, may be used to guide hose over the guide rollers 26A. The length of the guide rollers, cleaning heads, drive roller, and pressure roller along with the guide pins of the hose washing apparatus of the present invention may all be varied by interchanging these parts depending on the width of hose which is to be cleaned. Alternatively, the present invention may be provided with, for example, a drive roller, cleaning heads and guide rollers of a certain length with variable hose widths accommodated by varying the sizes or settings of the guide pins.

In conjunction with guide rollers, the present invention may also comprise a drive system. The drive system functions to transport hose through the machine and in its most preferred mode reduces the volume of water left on the hose after washing by wringing the hose.

Generally, the drive system may be any configuration of elements which facilitate transport of the hose through the hose washing apparatus of the present invention. Preferably, as can be seen in FIG. 2, the drive system comprises a drive roller 28 and a pressure roller 30. The drive roller 28 generally comprises a controllably rotatable sleeve which again is attached to the back plate 20 through any variety of means known to those of skill in the art. Simultaneously, the drive roller is preferably externally connected to any number of means for providing power effective in transporting the hose through the apparatus.

Preferably, the drive roller will be attached to means such as an electric or fossil fuel driven motor 40, FIG. 1, used to power the drive system. In this specific instance, shaft 39 extends from coupling 41 through the back plate 20 in front of the back plate 20. The drive roller 28 is then generally fastened to the shaft 39. Optionally, drive roller 28 may also comprise splines or notches to create a friction between rollers 28 and 30. In turn, shaft 39 may be keyed through coupling 41 to the motor 40.

One advantage of the present invention is the application of high pressure water which allows for efficient cleaning in a much shorter time period than prior art processes. As a result, the drive roller 28 may be set through motor 40 to move at a rate which effectively pulls the hose through the apparatus at a rate ranging from about 4 ft/min to about 25 ft/min., preferably about 12 ft/min. to 22 ft/min. depending upon water temperature, hose condition, and motor horsepower among other factors. These ranges are only guidelines which depend substantially on the condition of the hose. However, these ranges have been found to maximize the efficiency of cleaning while also providing an economical use of cleaning time.

The drive system of the present invention preferably also comprises a pressure roller 30, FIG. 2. While the drive roller 28 of the present invention provides a means for transporting the work piece or hose through the apparatus, the pressure roller 30 facilitates the driving process by maintaining tension upon the hose. The pressure roller pinches or secures the hose between itself and the drive roller resulting in the friction pulling of hose through the drive system and apparatus. In the process of maintaining a tension grip on the hose, the pressure roller also effectively forces or wrings water from the body of the hose. The pressure roller will have this effect on hose regardless of the nature of the outer lining of the hose, cloth or otherwise.

In the most preferred embodiment, the pressure roller lies parallel to the drive roller and is in tension contact with the drive roller 28. The tension contact of the pressure roller results from the application of spring 32 which is in turn affixed to stationary pin 31. Pin 31, in turn, may be attached to back plate 20 through any number of means known to those of skill in the art including bolting. Optionally, the pressure roller 30 may also comprise a handle 29. The handle 29 allows easy insertion as well as removal of the hose once the cleaning operations have been completed.

Optionally, the hose washing apparatus of the present invention may also comprise one or more guide pins 36A and 36B, FIGS. 2 and 4. The guide pins further facilitate transport of the hose through the apparatus of the present invention. Generally, the guide pins may take any position or shape which facilitates this purpose.

Preferably, as can be seen in FIGS. 1 and 2, the guide pins are positioned in two locations, the first set of guide pins is positioned on the leading edge or first edge of the back plate at which point the hose is introduced into the apparatus. This set of guide pins may be positioned in front of the first guide roller 26A and cleaning head 22A. Here again, the guide pins may be affixed to the back plate 20 through any variety of means known to those of skill in the art such as bolting and the like.

The second set of guide pins 36B is preferably positioned between the third guide roller 26c and the drive system, drive roller 28 and pressure roller 30, FIG. 2. Here again, this set of guide pins 36B facilitates transport of the hose from the third guide roller 26C through the drive system so that the hose is positioned properly on the rollers.

Preferably, the sets of guide pins 36A and 36B are configured so that they can be adjusted through set pins 37, FIGS. 1 and 2. In accordance with this mode of the present invention, the guide pin sets would have apertures at various distances across the length of the guide pins. These apertures would correspond to various widths of hose to be applied and processed by the process of the present invention. By narrowing the distance between the set pins 37 on any given set of guide pins, the guide pins would be set to accommodate hose of a narrower or broader width.

Alternatively, guide wires may be used to draw and guide hose over the guide rollers and through the apparatus. In this instance, guide wires having varying widths are attached to the guide rollers in the path of nozzles 24. The guide wires may be fit to the guide rollers through any variety of attaching mechanisms such as friction fitting, bolting and the like. In turn, the guide wires may be constructed from high strength wire such as alloyed aluminum, steel or stainless steel. The use of wire having a high strength allows using narrower wire, such as diameters ranging from about 3/16 inch to ⅜ inch, which does not obstruct the flow of water to the hose surface as it passes over the guide roller. The guide wire may also be fit to various sizes allowing the use of one standard size of guide roller and cleaning head and alternating the size of guide wire to accommodate different width hoses.

The hose washing apparatus of the present invention may optionally also comprise means for taking up and dispensing hose. These elements provide ease in coordinating hose which is to be washed and processed by the hose washing apparatus of the present invention. Generally, dispensing means may be any number of elements such as reel 34, FIG. 2, which allows for dispensing hose through the apparatus of the present invention.

In turn, take up means may also be any number of mechanisms including a reel, bin or other such means. For example, a reel may either be manually driven or mechanically driven to accept the hose which has been processed by the apparatus of the present invention. A take up reel may be powered by hand crank, electrically driven motor, fossil fuel driven motor, or any other means known to those of skill in the art. The take up reel may even further be driven by the motor used to empower drive roller 28 with the provision of proper gearing to allow for a coordination of speed between the rate of the drive roller 28 revolution and the rate of revolution of the take up reel.

As shown in FIGS. 1 and 2, a bin may also be used to capture hose as it is processed by the apparatus. The hose may then be manually wound or transported to a drying rack or tower. While any number of means have been discussed a bin has been found preferable.

The hose washing apparatus of the present invention may also comprise a tripping mechanism which is interconnected with the drive roller 28. In certain instances, it may be desirable to wash hose which has end couplings of substantial size and weight, such as for example, fire hose. This type of coupling may not pass easily through the apparatus of the present invention. Accordingly, a trip mechanism or bar 35 may be set up at the first or leading edge of the back plate 20 to trigger by mechanical or electrical interconnect which interrupts the revolution of the drive system and specifically the drive roller 28.

Generally, any trip mechanism known to those of skill in the art may be used which will adequately provide for terminating the revolution of the drive roller under the appropriate circumstances. Preferably, a trip bar 35 would be placed adjacent the first set of guide pins 36A, if present, or the first guide roller 26A. The trip bar 35 may be placed through a slot 33 in back plate 20 and may be slidable within that slot. Within the slot, the trip bar is held towards the front edge of the back plate 20 by tension created by means such as the spring. Upon passing of a hose coupling to the apparatus, the trip bar 35 retracts within the slot thereby activating a mechanical or electrical interconnect which interrupts the revolution of the drive roller 28.

In accordance with the invention, two automatic shut off or stop mechanisms can be seen in FIG. 4. First, an electrical safety switch 65 may be used at the hood opening. In this instance, once the machine is activated, lifting the hood 93 will release safety switch 95 which with electrical interconnection to the motor 50, will stop revolution of drive wheel 28 and, in turn, movement of the hose through the apparatus.

Alternatively, an automatic shut off comprising a plate 62 with hinged attachment 61 (FIG. 6), a flange 66, and a proximity sensor 65 (FIGS. 4–6) may be configured in an area such as next to roller 26A. In operation, as a hose coupling falls over roller 26A the coupling contacts plate 62 moving the plate in a downward direction. The plate 62 continues to move downward until plunger 71 attached to flange 66 activates the sensor 65. Overextension of plate 62 may be prevented by means such as spring 69, or side portions 60 and 64 which rest against the back plate 20 when the plate 62 is fully extended downward to activate sensor 65. The flange 66, attached to the plate 62 contacts the proximity sensor 65 which transmits an electrical charge stopping the motor.

Generally, the automatic shut off may comprise any number of sensory means 65 necessary to complete this function in accordance with the invention including mechanical, electromechanical, electrical circuitry, or semiconductor devices. Semiconductor devices which may be used include sensors such as physical sensors, electro-optical sensors, and electrical sensors, among others. One sensor found useful in the invention is a proximity sensor available through sources such as Baumer Electric, 3M (Minnesota Mining and Manufacturing Co.), or Square D Corporation. One sensor found preferable includes the Square D Series A Class 9006 proximity sensor requiring a supply voltage of 240 VAC with a 5-300 milliamp load.

Figure 6:
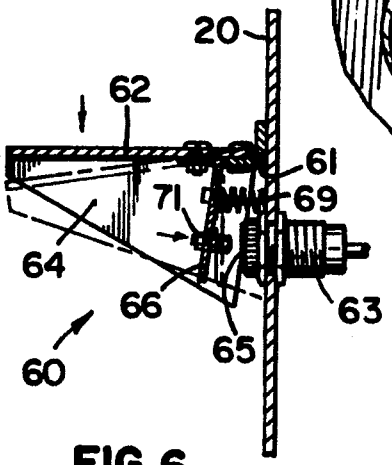
FIG. 6 is a cross-sectional view of the shut off means shown in FIG. 5 taken along lines 6—6.

As can be seen in FIG. 6, sensor 65 may be affixed to the back plate 20 through any variety of means such as a bolt, washer, lock unit and the like attached on the back side 63 of the sensor 65.

As noted earlier, the apparatus of the present invention may be used as a self-standing hose cleaning machine through an independent high pressure water source 50, FIG. 3. Alternatively, the high pressure hose cleaner of the present invention may also be used as an accessory to a high pressure water system. In this instance, the present invention may be used as an accessory for any number of high pressure water systems such as those sold by Aaladin Inc., Hotsy Inc., and L and A, Inc.

In application, the apparatus of the present invention is used by merely loading the hose from let out reel 34 into the apparatus. In the case of hose comprising couplings, the hose most appropriately may be loaded from a dispensing reel 34 threaded through the various points in the apparatus, i.e. over the guide rollers and through the drive system. The hose washing apparatus of the present invention is activated by initiating the flow of high pressure water and subsequent manual or mechanical movement of the drive system to pull the hose through the apparatus. Once the hose is completely processed, it may be fully dispensed into bin 38 and, depending upon type of hose, either rolled or placed in a hanging tower for completed drying.

The above discussion, examples, and embodiments illustrate my current understanding of the invention. However, since many variations in the invention can be made without departing from the spirit and scope of the invention, the invention resides wholly in the claims hereafter appended.

I claim as my invention:

1. A method of washing hose using high pressure water, said hose comprising an outer cloth nap, said method comprising the steps of:

a) drawing said hose into the path of said high pressure water;

(b) manipulating said hose in a serpentine manner to expose the outer nap of said hose to said high pressure water; and (c) applying a spray of water, at a high pressure ranging from about 200 psi to 1000 psi, into the outer nap of said hose.

2. The method of claim 1 wherein said hose is pulled through the water spray as the high pressure water is applied.

3. The method of claim 2 wherein the hose is pulled through the water spray at a rate of about 4 feet per minute to 25 feet per minute.

4. The method of claim 3 wherein said water pressure ranges from about 500 psi to 900 psi.

5. The method of claim 3 wherein the water spray is angled in substantially the same direction as the hose is being drawn.

6. A method of using a high water pressure hose washing apparatus to wash hose comprising an outer cloth nap, said hose washing apparatus comprising means for supporting the apparatus, high pressure water means for washing hose mounted to the support means, said washing means comprising one or more nozzles for directing water towards an area adjacent said support means and means for drawing the hose towards said nozzle, said method comprising the steps of:

(a) inserting a hose into said apparatus and pulling said hose through the apparatus, said hose comprising an outer cloth nap whereby said hose is directed towards said nozzle by said guide means;

(b) manipulating the hose in a serpentine manner to expose the outer nap of said hose to the path of said high pressure water; and (c) applying a spray of water to the hose at a pressure ranging from about 200 psi to 1000 psi as the hose is pulled through the apparatus at a given rate.

7. The method of claim 6 wherein said hose is pulled at a rate of from about 4 feet per minute to 25 feet per minute.

8. The method of claim 6 wherein said hose washing apparatus uses a water pressure ranging from about 500 psi to 900 psi.

9. The method of claim 6 wherein said hose is pulled through the water spray as the high pressure water is applied.

10. The method of claim 6 wherein the hose is pulled through the water spray at a rate of about 4 feet per minute to 25 feet per minute.

11. The method of claim 6 wherein said hose washing apparatus uses a water pressure ranging from about 500 psi to 900 psi.

12. A method of using a high water pressure hose washing apparatus comprising a high pressure water source in communication with said apparatus producing water at a pressure ranging from about 200 psi to 1000 psi, high pressure water means for washing hose mounted on said apparatus, said high pressure water means in communication with said high pressure water source and comprising a first and second cleaning head, said first cleaning head comprising a perpendicular length mounted on said apparatus, said second cleaning head comprising a perpendicular length mounted on said apparatus, wherein each of said first or second cleaning heads comprise one or more nozzles for directing a high pressure flow of water onto hose in an area adjacent said apparatus support means, and means for guiding hose through the apparatus in a serpentine manner, said guiding means rotatably mounted to said apparatus support means and comprising a first, and second guide roller, said guide rollers each comprising a length attached to, and extending outwardly from said apparatus, said first and second guide rollers mounted to said apparatus support means respectively adjacent said first and second cleaning heads and positioned in the path of said first and second cleaning head nozzles wherein said first and second guide rollers are positioned to transport hose in a serpentine manner through the path of said high pressure spray, said method comprising the steps of:

(a.) inserting said hose into said apparatus and drawing said hose in a serpentine pattern through the apparatus whereby said hose is drawn into the path of said nozzle by said first and second guide rollers;

(b.) manipulating said hose in a serpentine manner to expose said hose to said high pressure water; and (c) applying a spray of water to the hose at a pressure from about 200 psi to 1000 psi.

13. The method of claim 12 wherein said apparatus support means comprises a rigid back plate having a thickness, length and width adequate to support the hose washing apparatus, said apparatus support means further comprising a top and bottom edge, and first and second side edges

14. The method of claim 13 wherein said apparatus comprises means for driving hose through the apparatus, said drive means comprising a drive roller and a pressure roller each mounted to said apparatus support means, said drive roller positioned adjacent said apparatus support means second side edge, said pressure roller comprising a rotatable length in tension contact with said drive roller, said pressure roller positioned parallel to said drive roller and perpendicular to said apparatus support means, said pressure roller supportably mounted to said apparatus support means through a spring.

15. The method of claim 14 wherein said drive roller is externally connected to a power source used to rotate said drive roller.

16. The method of claim 15 wherein said apparatus additionally comprises means for interrupting the revolution of the drive roller, said interrupting means extending through a slidably attached to said apparatus support means first side edge, said interrupting means interconnected to said drive roller wherein activation of said interrupting means controllably stops the revolution of said drive roller.

17. The method of claim 13 wherein said apparatus comprises:

(a) high pressure water means for washing hose comprising a first and second cleaning head, said first cleaning head comprising a perpendicular length mounted on and passing through said apparatus support means adjacent said apparatus support means top and first side edges, said first cleaning head comprising two ore more spray nozzles for directing water generally parallel to said apparatus support means in an area generally adjacent to said apparatus support means, said second cleaning head comprising a perpendicular length mounted on and passing through said apparatus support means adjacent said apparatus support means bottom edge and middle area, said second cleaning head comprising two ore more spay nozzles for directing water generally parallel to said apparatus support means in an area adjacent said apparatus support means; and (b) means for guiding hose through the apparatus comprising a first and second guide roller rotatably attached to said apparatus support means, said first guide roller comprising a length extending outward from said apparatus support means adjacent and parallel to said first cleaning head in the path of said first cleaning head nozzles, said second guide roller comprising a length extending outward from said apparatus support means adjacent said second cleaning head in the path of said second cleaning head nozzles.

18. The method of claim 17 wherein said apparatus comprises a third guide roller comprising a perpendicular length extending outwardly from, and rotatably attached to, said apparatus support means adjacent said drive roller and said apparatus support means top and second side edges and, wherein said first cleaning head nozzles are directed downward, said second cleaning head nozzles are directed upward, and said first, second, and third guide rollers are positioned to transport hose in a serpentine pattern across the surface of said apparatus support means.

19. The method of claim 12 wherein said hose is pulled through the water spray as the high pressure water is applied.

20. The method of claim 12 wherein the hose is pulled through the water spray at a rate of about 4 feet per minute to 25 feet per minute.

21. The method of claim 12 wherein said hose washing apparatus uses a water pressure ranging from about 500 psi to 900 psi.

22. The method of claim 12 wherein the water spay is angled in substantially the same direction as the hose is being drawn.

* * * * *